US005571444A

United States Patent [19]

Fisher et al.

[11] Patent Number: 5,571,444

[45] Date of Patent: Nov. 5, 1996

[54] TEXTILE TREATMENT

[75] Inventors: Arthur D. Fisher, Gisborne, Australia; Dieter Reinehr, Kandern, Germany; Jorg Binz, Reinach; Sven Strunk, Ormalingen, both of Switzerland

[73] Assignee: Invicta Group Industries Pty Ltd., Braybrook, Australia

[21] Appl. No.: 583,891

[22] Filed: Jan. 11, 1996

Related U.S. Application Data

[63] Continuation of Ser. No. 335,563, Nov. 7, 1994, abandoned, which is a continuation of Ser. No. 109,298, Aug. 19, 1993, abandoned, which is a continuation of Ser. No. 850,195, Mar. 11, 1992, abandoned which is a continuation-in-part of PCT/AU90/00410, Sep. 11, 1990, and a continuation-in-part of PCT/AU91/00001, Jan. 2, 1991.

[30] Foreign Application Priority Data

| | | | |
|---|---|---|---|
| Sep. 11, 1989 | [AU] | Australia | PJ6291 |
| Jan. 2, 1990 | [CH] | Switzerland | 12/90 |

[51] Int. Cl.[6] ..... D06M 13/358

[52] U.S. Cl. ..... 252/8.62; 252/8.61; 8/115.51; 8/115.56; 8/115.57; 8/115.58; 8/115.59; 8/115.68; 8/115.6; 8/115.7; 8/442; 8/455; 8/560; 8/929; 8/190; 427/389; 427/389.9; 427/394

[58] Field of Search ..... 252/8.6, 8.7, 8.75, 252/8.8, 8.9; 8/190, 115.51, 115.56, 115.57, 115.58, 115.59, 115.68, 115.6, 115.7, 442, 455, 929, 560; 427/389, 389.9, 394

[56] References Cited

U.S. PATENT DOCUMENTS

| | | | |
|---|---|---|---|
| 3,278,253 | 10/1966 | Weckler | 8/493 |
| 3,743,477 | 7/1973 | Egli | 8/448 |
| 3,890,091 | 6/1975 | Cathelin | 8/495 |
| 3,926,548 | 12/1975 | Moriyama | 8/115.7 |
| 3,959,559 | 5/1976 | Kimoto | 428/394 |
| 4,501,591 | 2/1985 | Ucci | 8/495 |
| 4,563,189 | 1/1986 | Lewis | 8/493 |
| 4,592,940 | 6/1986 | Blyth | 428/96 |
| 4,671,884 | 6/1987 | McKinnon | 252/8.8 |
| 4,680,212 | 7/1987 | Blyth | 428/97 |
| 4,737,155 | 4/1988 | Rollick | 8/442 |
| 4,780,099 | 10/1988 | Greschler | 8/115.6 |
| 4,800,118 | 1/1989 | Reed | 428/270 |
| 4,831,068 | 5/1989 | Reinert | 524/100 |
| 4,865,885 | 9/1989 | Herlant | 427/322 |
| 4,875,901 | 10/1989 | Payet | 8/115.56 |
| 4,940,757 | 7/1990 | Moss | 525/502 |
| 4,950,301 | 8/1990 | Lewis | 8/127.5 |
| 4,963,409 | 10/1990 | Liss | 428/96 |
| 4,964,871 | 10/1990 | Reinert | 8/115.59 |
| 4,965,325 | 10/1990 | Liss | 525/508 |
| 5,098,774 | 3/1992 | Chang | 428/267 |

FOREIGN PATENT DOCUMENTS

| | | |
|---|---|---|
| 44105/58 | of 1958 | Australia . |
| 0175225 | of 1985 | European Pat. Off. . |
| 60-004071 | 11/1984 | Japan . |
| 60-273481 | 9/1985 | Japan . |
| 1444426 | 7/1976 | United Kingdom . |

OTHER PUBLICATIONS

C.A. 111:8823b (1988).
C.A. 111:8822a (1988).
C.A. 110:77383z (1988).

*Primary Examiner*—Anthony Green
*Attorney, Agent, or Firm*—Robert S. Honor; Carl W. Battle; Hesna J. Pfeiffer

[57] ABSTRACT

A textile treatment composition which comprises; a textile binding agent which forms a chemical bond with the outer layer of the textile according to the formula (Ia):

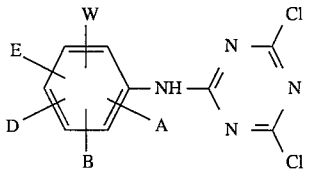

(Ia)

and, a barrier agent which forms a chemical bond with the textile binding agent and which increases the surface tension of the textile. Methods for treating textiles with the treatment composition, and kits comprising the components are also provided.

17 Claims, No Drawings

TEXTILE TREATMENT

This is a continuation of application Ser. No. 08/335,563, filed Nov. 7, 1994, abandoned, which in turn is a continuation of application Ser. No. 08/109,298, filed Aug. 19, 1993, abandoned, which in turn is a continuation of application Ser. No. 07/850,195, filed Mar. 11, 1992, abandoned, which in turn is a CIP of PCT/AU90/00410, filed Sep. 11, 1990 and a CIP of PCT/AU91/00001, filed Jan. 2, 1991.

BACKGROUND OF THE INVENTION

The present invention relates to a textile treatment composition, methods of treating textiles and to textiles which have been treated. Compositions and methods of the present invention are especially suitable to impart stain resist properties to textiles such as wool, cotton and nylon, but the invention is not limited thereto.

Various processes exist for the treatment of textiles to impart some stain resist qualities thereto. These processes have limited effectiveness with some textiles such as wool. For example, fluorocarbons are used to provide oil and water repellancy to textiles such as fabrics, furnishings, carpets and clothing. The fluorocarbon prevents wetting of the textile thus minimizing contact between the textile and the foreign substance. However such treatment does not impart stain resist properties to the textile and such an approach offers little protection to the textile where the foreign substance is a substance such as F D & C Red 40, an acid dye commonly added to food and beverages. Such treatment is also non-durable and wears off quickly. Some processes exist that are suitable to treat nylon, for example nylon carpets, however it has been found that these treatments are unsuitable to treat wool, for example wool carpets.

It is known that wool fibre material can be treated with sulphonated compounds so as to protect the material against soiling by oily foods or aqueous beverages which have been dyed with synthetic dyes such as F D & C Red 40. See for example U.S. Pat. No. 4,699,812 and 4,857,392. However, the stain resisting effect is inadequate.

It is also widely known that the lack of durability of stain resist finishes of nylon carpets is such that it does not allow the use in commercial installations.

European Patent Application 267681 discloses a method for providing fibrous polyamide materials with stain resistance comprising contacting the fibrous polyamide materials with aqueous solution comprising a normally solid, water-soluble, partially sulphonated resin, which comprises the condensation product of at least one phenolic compound and an aldehyde, and a water-soluble divalent metal salt.

U.S. Pat. No. 4,592,940 discloses a process for imparting stain resistance to a carpet having a pile made of nylon yarn comprising immersing the carpet in an aqueous solution of a selected phenol-formaldehyde condensation product.

U.S. Pat. No. 4,501,591 discloses an improvement in certain processes for continuously dyeing polyamide carpets whereby stain resistance is imparted to the carpets during the dyeing process. The improvement comprises adding an alkali metal silicate and a sulphonated phenol-formaldehyde condensation product to the dye liquor used in the dyeing process.

European Patent Application 235 989 discloses an improvement in a process for applying sulphonated naphthol- or sulphonated phenol-formaldehyde condensation products to polyamide textile articles to render them stain resistant, the improvement comprising applying the condensation products at a pH of between 1.5 and 2.5.

U.S. Pat. No. 4,940,757 discloses a stain resistant composition which is prepared by polymerizing an α-substituted acrylic acid in the presence of a sulphonated aromatic formaldehyde condensation polymer.

SUMMARY OF THE INVENTION

It is an object of the present invention to overcome, or at least alleviate, one or more of the difficulties related to the prior art.

Accordingly, in a first aspect of the present invention there is provided a textile treatment composition including an effective amount of:

- a textile binding agent which forms a chemical bond with the outer layer of the textile; and
- a barrier agent which forms a chemical bond with said binding agent and which increases the surface tension of the textile.

DETAILED DESCRIPTION OF THE INVENTION

The textile treatment composition may be a textile stain-resistance composition. The textile treatment composition is also preferably a composition which provides improved stain-resistant properties and/or improved twist retention and/or improved wearability.

When used herein, the term "textile" refers to both textiles which are comprised of natural fibres and/or synthetic fibres, for example wool, cotton and nylon and also blends of natural fibres and synthetic fibres. The reference to textiles herein includes all textiles to which the method and composition according to the invention is found suitable.

When used herein, the term "textile binding agent" refers to an agent which forms a chemical bond with the outer layer of the textile. The bond formed is preferably a covalent bond. The bond may be formed between the compound and amino groups in the textile.

The textile binding agent may be a dye inhibitor agent. The textile binding agent may be an organic compound. The textile binding agent preferably has groups capable of forming a chemical bond to amino groups in the textile to form covalent bonds. The textile binding agent and barrier agent may be present in any effective relative amounts. The textile binding agent and barrier agent may be present in a weight ratio of from approximately 1:2 to 10:1, preferably approximately 2:1 to 7:1. The textile binding agent may be present in amounts of from approximately 35 to 90% by weight preferably approximately 50 to 90% by weight, based on the total weight of the textile treatment composition.

The barrier agent may be present in amounts of from approximately 10 to 65% by weight, preferably approximately 20% to 50% by weight, based on the total weight of the textile treatment composition.

In one embodiment of the present invention the textile binding agent is an aryl or alkyl amine. In one form the amine may be a primary, secondary or tertiary. the binding agent is preferably an aromatic amine. In a preferred embodiment binding agent is a substituted triazine. Preferably said substituted triazine is a monosubstituted dihalotriazine. The binding agent may be any compound having groups capable of linking to amino groups in the fibres to form covalent bonds including for example halopyrimidinyl, haloquinoxalyl, haloacrylamido, vinylsulpho or any other groups that can produce these groups. The binding agent may be a compound having anionic groups such as sulphonate, carboxylate, sulphate or phosphate.

In a preferred embodiment the textile binding agent is a substituted triazine which may take the form shown in formula I:

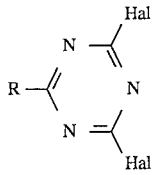

(I)

wherein R is a polar substituent, preferably hydrogen, halogen, hydroxy, or an organic polar substituent. R is preferably a substituted phenyl, benzyl or naphthyl group. Suitable substituents on the phenyl, benzyl or naphthyl group include hydrogen, hydroxy, halogen or any organic radical.

In a preferred embodiment R is $R_1X$ wherein $R_1$ may be any polar substituent. $R_1$ may be an unsubstituted phenyl or naphthyl radical or one which is substituted by $C_1$–$C_4$-alkyl, —$SO_3M$ or —COOM groups, where M is hydrogen or a counterion such as an alkali metal, alkaline earth metal or an ammonium cation. Other suitable substituents include hydrogen, hydroxy, halogen or any organic radical. In a further preferred embodiment $R_1$ is a sulphophenyl or sulphonaphthyl group;

X may be oxygen, sulphur or $NR_2$wherein $R_2$ is hydrogen or a lower alkyl group such as a $C_1$–$C_4$ alkyl group or any other suitable organic radical; Hal may be any suitable halogen. Hal is preferably Cl.

Preferred $C_1$–$C_4$-alkyl groups include methyl, ethyl, n-propyl, isopropyl, n-butyl, sec-butyl or ter-butyl. $R_2$ is preferably hydrogen.

M as alkali metal cation signifies preferably the sodium or potassium cation; as alkaline earth metal cation the calcium or magnesium cation and as ammonium cation one of the formula $$\overset{\oplus}{N}R_1R_2R_3R_4$$

where $R_1$, $R_2$, $R_3$ and $R_4$ signify, independently from each other, hydrogen, $C_1$–$C_4$-alkyl, β-hydroxy-$C_1$–$C_4$-alkyl or a cyclohexyl radical, where at least two of these residues can form a carbon- or heterocyclic ring system.

$C_1$–$C_4$-alkyl radicals $R_1$, $R_2$, $R_3$ or $R_4$ assume the significance given above.

β-hydroxy-$C_1$–$C_4$-alkyl radicals $R_1$–$R_4$ are for example hydroxyethyl, β-hydroxypropyl and β-hydroxybutyl.

Carbon and heterocyclic ring systems which are formed by at least two of the radicals $R_1$–$R_4$ with the N-atom to which they are bound, are for example cyclohexylamine, dicyclohexylamine or morpholine.

Substituted phenyl radicals R are preferably substituted by a $SO_3M$ group or by a $C_1$–$C_4$-alkyl radical and a $SO_3M$ group. $C_1$–$C_4$-alkyl and M assume the significance given above.

The compounds of formula (1) where R is $R_1X$ are known as such, for example, from U.S. Pat. No. 3,743,477 and can be produced according to the process described in the U.S. Pat. No. 3,278,253, ie. by condensation of 2,4,6-trichloro-1,3,5-triazine with an amine $HNR_oR$, an alcohol HOR or a mercaptan HSR, where $R_o$ and R have the significance given above.

Preferably, the textile binding agent may include a compound having the general formula (Ia)

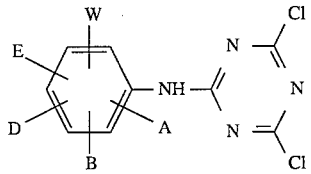

(Ia)

wherein W is $SO_3H$ and A, B, D and E, which are the same or different, are hydrogen or halogen atoms, or hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, —$CO_2R^1$, —$CONR^1R^2$, —$COR^1$, —$CR^1$=$NR^2$, —N=$CR^1R^2$ or —$S(O)_nR^1$ groups, any two of the groups A, B, D and E, when they are in adjacent positions on the ring, optionally join to form a fused ring, either aromatic or aliphatic, optionally containing one or more heteroatoms; n is 0, 1 or 2; and $R^1$ and $R^2$, which are the same or different, are hydrogen atoms or alkyl, cycloalkyl, cycloalkylalkyl, alkenyl, alkynyl, optionally substituted aryl or optionally substituted aralkyl groups.

Alkyl groups and the alkyl moiety or alkoxy groups may be in the form of straight or branched chains, and preferably contain 1 to 6 carbon atoms, more preferably 1 to 4 carbon atoms.

The alkyl group may be selected from methyl, ethyl, propyl (n- and iso-propyl) and butyl (n-sec, iso- and tert butyl). Cycloalkyl groups, which are preferably $C_{3-6}$ cycloalkyl groups, including cyclohexyl and cycloalkylalkyl groups, which are preferably $C_{3-6}$ cycloalkyl $(C_{1-4})$alkyl groups, include cyclopropylethyl. Alkenyl and alkynyl groups preferably contain 2 to 6, more preferably 2 to 4, carbon atoms in the form of straight or branched chains, for example ethenyl, allyl and propargyl.

The aryl group is preferably phenyl. The aralkyl group may be benzyl, phenylethyl or phenyl-n-propyl. Optionally substituted alkyl groups include haloalkyl, hydroxyalkyl, alkoxyalkyl. The optionally substituted aryloxyalkyl group may be an optionally substituted phenoxyalkyl. The optionally substituted heteroaryloxalkyl groups include pyridinyl- and pyrimidinyloxyalkyl. The optionally substituted alkenyl group includes optionally substituted phenylalkenyl, preferably optionally substituted phenylethenyl. Optionally substituted arylalkoxy includes optionally substituted benzyloxy.

Substituents which may be present in any optionally substituted aryl or heteroaryl moiety include one or more of the following: halogen preferably fluorine, chlorine and bromine; $C_{1-4}$ alkyl, preferably methyl and ethyl; $(C_{1-4})$ alkoxy, preferably metholy; halo $(C_{1-4})$alkyl preferably trifluoromethyl; halo $C_{1-4}$ alkoxy preferably trifluoromethoxy; $C_{1-4}$ alkylthio preferably methylthio; $C_{1-4}$ alkoxy $(C_{1-4})$alkyl, $C_{3-6}$ cycloalkyl; $C_{3-6}$ cycloalkyl-$(C_{1-4})$ alkyl, aryl preferably phenyl; aryloxy preferably phenyloxy; aryl $(C_{1-4})$ alkyl preferably benzyl, phenylethyl and phenyl n-propyl; aryl $(C_{1-4})$alkoxy preferably benzyloxy; aryloxy $(C_{1-4}$ alkyl preferably phenyloxymethyl; acyloxy preferably acetyloxy and benzoyloxy; cyano; thiocyanato; nitro;

—$NR^1R^2$; —$NHCOR^1$; —$NHCONR^1R^2$, $COOR^1$; —$OSO_2R^1$; —$SO_2R^1$; —$COR^1$; —$CR^1{=}NR^2$ or —$N{=}CR^1R^2$ wherein $R^1$ and $R^2$ may be independently hydrogen, $C_{1-4}$ alkyl, $C_{1-4}$ alkoxy, $C_{1-4}$ alkylthio, $C_{3-6}$ cycloalkyl, $C_{3-6}$ cycloalkyl ($C_{1-4}$)-alkyl, phenyl or benzyl, in which the phenyl and benzyl groups may be optionally substituted with halogen, $C_{1-4}$ alkyl or $C_{1-4}$ alkoxy.

Optionally substituted amino, acylamino and acyloxy groups include the groups —$NR^1R^2$, —$NHCOR^1$ and —$OCOR^1$ in which $R^1$ and $R^2$ are as defined in the preceding paragraph.

It is preferred that at least one of A, B, D and E is an alkyl group, such as methyl, but it can be in any relationship (ortho, meta or para) to the sulphonic acid group W, which can also be in any position on the ring.

In a further preferred form the binding agent includes a compound of formula Ib:

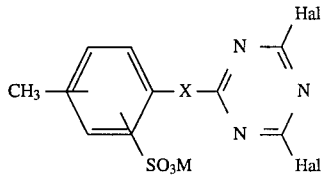

(Ib)

wherein X is $NR_2$, wherein $R_2$ is hydrogen or $C_{1-4}$ alkyl and M is hydrogen or a counterion such as an alkali metal, alkaline earth metal or an ammonium cation; or any isomer thereof.

In a more preferred embodiment binding agent (a) includes a compound selected from:

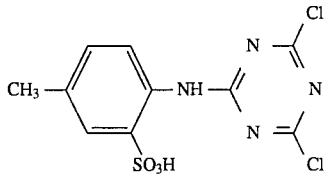

2-[(4,6-dichloro-1,3,5-triazin-2-yl)amino]-5-methylbenzene sulphonic acid

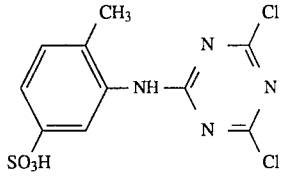

3-[(4,6-dichloro-1,3,5-triazin-2-yl)amino]-4-methylbenzene sulphonic acid

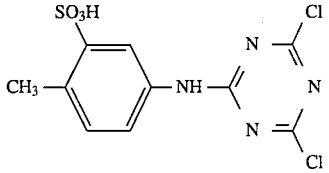

5[(4,6-dichloro-1,3,5-triazin-2-yl)amino]-2-methylbenzene sulphonic acid or any isomers and/or mixtures thereof.

In an especially preferred embodiment the textile binding agent includes the compound or mixture of compounds sold under the trade designation "Paranyl B" which includes the above compounds, or "Sandospace R" which is the sodium salt of 2,4,-dichloro-6-p-sulphoaniline 1,3,5-triazine, or Sandospace "S".

In a further preferred embodiment the textile binding agent includes a compound of formula Ic:

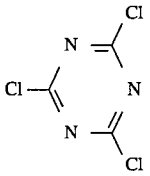

(Ic)

When used herein, the term "barrier agent" refers to a compound which forms a chemical bond with the binding agent and which increases the surface tension of the textile. The compound preferably forms a covalent bond with the binding agent. The compound preferably has polar substituents in order to assist in the repulsion of compounds which may stain the textile.

Barrier agent is preferably a substituted aromatic hydroxy compound. Preferably said substituted aromatic hydroxy compound is a sulphonated aromatic hydroxy compound.

In a preferred form barrier agent (b) includes a compound of formula II;

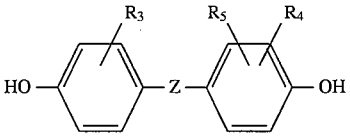

(II)

wherein $R_3$, $R_4$ and $R_5$ may be the same or different and are polar groups. $R_3$, $R_4$ and $R_5$ are preferably selected from hydrogen, halogen, hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, —$CO_2R^1$, —$CONR^1R^2$, —$COR^1$, —$CR^1{=}NR^2$, —$N{=}CR^1R^2$ or —$S(O)_nR^1$ groups where n is 0, 1 or 2 and $R^1$ and $R^2$, which are the same or different, are hydrogen atoms or alkyl, cycloalkyl, alkenyl, alkynyl, optionally substituted aryl or optionally substituted aralkyl groups. Preferred substituents are any sulphoalkyl substituents, hydroxy, —$SO_3H$

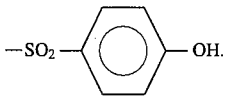

Alkyl groups and the alkyl moiety or alkoxy groups may be in the form of straight or branched chains, and preferably contain 1 to 6 carbon atoms, more preferably 1 to 4 carbon atoms.

The alkyl group may be selected from methyl, ethyl, propyl (n- and iso-propyl) and butyl (n-see-, iso- and tert butyl). Cycloalkyl groups, which are preferably $C_{3-6}$ cycloalkyl groups, include cyclohexyl and cycloalkylalkyl groups, which are preferably $C_{3-6}$ cycloalkyl ($C_{1-4}$)alkyl groups, include cyclopropylethyl. Alkenyl and alkynyl groups preferably contain 2 to 6, more preferably 2 to 4, carbon atoms in the form of straight or branched chains, for example ethenyl, allyl and propargyl.

The aryl group is preferably phenyl. The aralkyl group may be benzyl, phenylethyl or phenyl-n-propyl. Optionally substituted alkyl groups include haloalkyl, hydroxyalkyl, alkoxyalkyl. The optionally substituted aryloxyalkyl group may be an optionally substituted phenoxyalkyl. The optionally substituted heteroaryloxalkyl groups include pyridinyl- and pyrimidinyloxyalkyl. The optionally substituted alkenyl group includes optionally substitued phenylalkenyl, preferably optionally substituted phenylethenyl. Optionally substituted arylalkoxy includes optionally substituted benzyloxy.

Substituents which may be present in any optionally substituted aryl or heteroaryl moiety include one or more of the following: halogen preferably fluorine, chlorine and bromine; $C_{1-4}$ alkyl, preferably methyl and ethyl; ($C_{1-4}$) alkoxy, preferably metholy; halo ($C_{1-4}$) alkyl preferably trifluoromethyl; halo $C_{1-4}$ alkoxy preferably trifluoromethoxy; $C_{1-4}$ alkylthio preferably methylthio; $C_{1-4}$ alkoxy ($C_{1-4}$) alkyl, $C_{3-6}$ cycloalkyl; $C_{3-6}$ cycloalkyl-($C_{1-4}$) alkyl; aryl preferably phenyl; aryloxy preferably phenyloxy; aryl ($C_{1-4}$) alkyl preferably benzyl, phenylethyl and phenyl n-propyl; aryl ($C_{1-4}$) alkoxy preferably benzyloxy; aryloxy ($C_{1-4}$) alkyl preferably phenyloxymethyl; acyloxy preferably acetyloxy and benzoyloxy; cyano; thiocyanato; nitro; —$NR^1R^2$; —$NHCOR^1$, —$NHCONR^1R^2$; $COOR^1$; —$OSO_2R^1$; —$SO_2R^1$; —$COR^1$; —$CR^1{=}NR^2$ or —$N{=}CR^1R^2$wherein $R^1$ and $R^2$ may be independently hydrogen, $C_{1-4}$ alkyl, $C_{1-4}$ alkoxy, $C_{1-4}$ alkylthio, $C_{3-6}$ cycloalkyl, $C_{3-6}$ cycloalkyl ($C_{1-4}$)-alkyl, phenyl or benzyl, in which the phenyl and benzyl groups may be optionally substituted with halogen, $C_{1-4}$ alkyl or $C_{1-4}$ alkoxy.

Optionally substituted amino, acylamino and acyloxy groups include the groups —$NR^1R^2$, —$NHCOR^1$ and —$OCOR^1$ in which $R^1$ and $R^2$ are as defined above.

Z is an electron drawing group. Z is preferably $R_6$—O—$R_7$ wherein $R_6$ and $R_7$ may be the same or different and may be any organic radical. In one form Z may be an ether group. Z is more preferably $SO_2$.

In a preferred embodiment of the invention barrier agent includes a compound selected from:

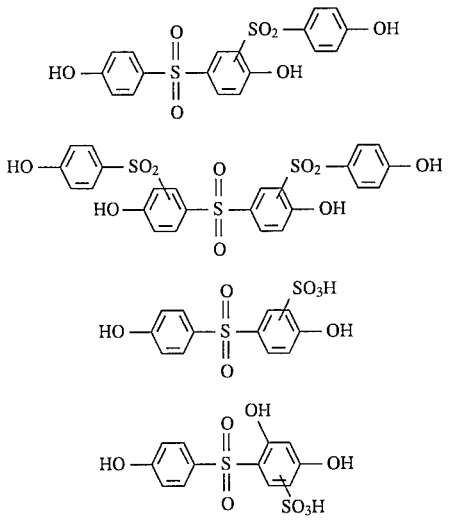

and all isomers and/or mixtures thereof.

In an especially preferred embodiment barrier agent includes the compound or compounds sold under the trade designation "Cibatex RN".

Other suitable barrier agents include the following aromatic syntans:

(a) polymeric condensation products which consist essentially of repeating units of the formula:

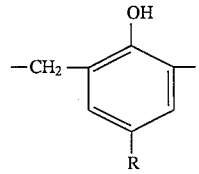

where R in each unit is either the same or different and signifies hydrogen or a radical selected from

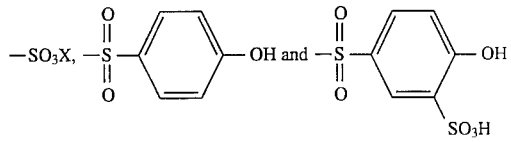

where X signifies hydrogen or a cation such as $NH_3$, Na, K. Such agents are, for example, condensation products of phenol sulphonic acid and dihydroxy-diphenylsulphone with formaldehyde or condensation products of naphthalene sulphonic acid and dihydroxy-diphenylsulphone with formaldehyde or condensation products of sulphonated naphthol, phenol or cresol with formaldehyde (cf. for example U.S. Pat. No. 4,680,212; EP-A-0,242,495 or EP-0,235,989). These products are also used as stain resisting agents and wet fastness improvers. Other agents can, for example be found in A. Chwala and V. Anger "Handbuch der Textilhilfsmittel" (Handbook for Textile Aids), 6/8 Verlag Chemic, Weinheim, N.Y. (1977).

(b) Condensation products from naphthalene sulphonic acid and formaldehyde;

(c) Formaldehyde condensation products of sulphonic group containing aromatic hydroxy compounds with aralkyl halogenides.

(d) Urea-formaldehyde condensation products of phenols and phenol sulphonic acids;

(e) Reaction product of phenol and a sulphonation agent, wherein the mole ratio phenol: ($SO_3$) is (1):(1.1–2.2);

(f) Condensation products of sulphonated diaryl ether and formaldehyde;

(g) Condensation products of sulphonated di- or terphenylene and formaldehyde;

(h) Condensation products of 4,4'-dihydroxy diphenyl sulphone and sulphonated 4,4'-dihydroxy-diphenylsulphone with formaldehyde and (i) Formaldehyde condensation products of diarylether sulphonic acid and 4,4'-dihydroxy diphenylsulphone.

The condensation products of the types (a), (b) and (f)–(i) are well known, for example from Ullmann's Enzyklopaedie der Technischen Chemie, Vol 16, (4), 140 (1979) and can be produced according to processes described in the references given therein.

Condensation products of the type (c) and their production are known from GB-C-986621.

Condensation products of the type (d) and their production are known from GB-C-890160 and 935678.

The reaction product of the type (e) and its production is known from EP-A-0215205. These reaction products can be condensed according to known methods to products of the type (d) (cf. for example GB-C-683084).

In a preferred embodiment barrier agent includes the condensation product of naphthalene sulphonic acid, dihydroxy-diphenylsulphone and formaldehyde. During the condensation different chemical substances are formed so an exact formula cannot be given. In an especially preferred embodiment the barrier agent may include the compound or mixture of compounds sold under the trade designation "Thiotan WPN Liquid".

In a further preferred embodiment barrier agent includes the compound or mixture of compounds sold under the trade designation "Nylofixan P" which is the condensation product of M-xylene sulphonic acid (ammonium salt), dihydroxy-diphenylsulphone and formaldehyde, "Mesitol NBS" which is the condensation product of dihydroxy-diphenyl sulphone and its sulphonated derivative with formaldehyde. In all above products of condensation with formaldehyde the precise structure is unknown and they all consist of mixtures of different chemical entities.

In a preferred aspect of the present invention the fibre treatment composition may further include a solvent for the textile binding agent and/or barrier agent. Accordingly, in a further aspect of the present invention there is provided a textile treatment composition including:

a textile binding agent which forms a chemical bond with the outer layer of the textile;

a barrier agent which forms a chemical bond with said binding agent and which increases the surface tension of the textile; and a solvent.

Any suitable solvent may be used. Suitable solvents include aqueous and organic solvents. In a preferred embodiment of the invention an aqueous solvent is used. Preferably the solvent is water of similar quality to that normally used in textile dyeing. In a preferred embodiment, the solvent used is a common solvent to that used in any other processes which may be used to treat the textile, such as dyeing. In one form the composition and for example a dye which may be used to treat the textile may both be placed in the same solution.

In a further preferred embodiment the composition of the present invention further includes a salt. The salt may include an alkali metal salt, for example sodium chloride (common salt).

It has surprisingly been found that the treatment with common salt during or subsequent to treatment with the composition in accordance with the method of the present invention increases the stain resistance imparted to the textile.

Accordingly in a further aspect of the present invention there is provided a textile treatment composition including an effective amount of:

a textile binding agent which forms a chemical bond with the outer layer of the textile;

a barrier agent which forms a chemical bond with said binding agent and which increases the surface tension of the textile; and a salt.

In a preferred embodiment the composition of the invention may be buffered to a desired pH. Preferably the composition is buffered in solution to have a pH less than 8. Preferably the composition is buffered such that it has a pH in solution of between 3.0 and 6.0.

The present invention also provides a method of treatment of a textile to render it stain resistant comprising:

providing a textile; and contacting the textile with a textile treatment composition including a textile binding agent which forms a chemical bond with the outer layer of the textile;

a barrier agent which forms a chemical bond with said binding agent and which lowers the surface tension of the textile;

for a time sufficient and at a temperature sufficient to permit reaction therebetween.

This method is particularly useful in treating wool of all types including but not limited to knitting wool and wool carpet; and other textiles such as nylon and cotton.

Preferably the composition used in the method includes a ratio of textile binding agent to barrier agent of from 1:2 to 10:1. The preferred ratio will depend on the textile binding agent and barrier agent used and also the textile to be treated. The ratio may be established by the person skilled in the art. When the composition is to be applied to wool or wool/nylon blends for example it has been found that when the compound or compounds sold under the trade designation "Paranyl B" is used as the textile binding agent, a ratio of 2:1 is suitable. It has been found when the compound or compounds sold under the trade designation "Sandospace R" is used as the textile binding agent that a ratio of between 6:1 and 7:1 is suitable, and 6.66:1 is especially suitable.

The term "wool/nylon blends" includes for example 80% wool to 20% polyamide and 70% wool to 30% polyamide which are commonly used in the carpet trade.

When the composition is to be applied to nylon it has been found that when the compound or compounds sold under the trade designation "Paranyl B" is used as the textile binding agent that a ratio of 0.8:1 is suitable. It has been found that when the compound or compounds sold under the trade designation "Sandospace R" is used as the textile binding agent that a ratio of between 2:1 and 3:1 is suitable and 2.66:1 is especially suitable.

The composition is preferably applied to the textile in an amount of between about 2 to about 35%, preferably about 5 to about 10% of composition to weight of textile to be treated. By way of example of the method 10 kilograms of a wool or wool/nylon blend carpet may advantageously be treated using a solution containing 0.75 kilograms of the compound or compounds sold under the trade designation "Paranyl B" agent and 0.375 kilograms of barrier agent, or 2.5 kilograms of the compound or compounds sold under the trade designation "Sandospace R" and 0.375 kilograms of binding agent.

The treatment solution which is used to treat the textile in accordance with the above method is heated. In the case of wool, the treatment solution is preferably heated to and maintained at a temperature within a range of about 85° C. to about 105° C. More preferably the treatment solution is heated to and maintained at a temperature of about 100° C. It will be appreciated that for textiles other than wool different temperatures may be used. It will also be appreciated that the temperature should not be so high as to damage the wool or other textile.

In accordance with the method of the present invention, the textile to be treated is placed in the treatment solution including the composition, for a time sufficient to allow the composition to act upon the textile. It will be appreciated that time will be dependent upon the nature of the textile and will also be temperature and pressure dependent. The treatment time may be established by a person skilled in the art according to the type of textile to be treated and the temperature and pressure used. By way of example, wool placed in the above referred to most preferred solution at 100° C. will require about 3 to 6 minutes. In one embodiment of the method, the treatment solution is provided by mixing the composition including binding agent and barrier agent as described above, together with an already existing solution used in the manufacturing process. Preferably the existing treatment solution meets the above preferred temperature, pH, solvent, pressure and other relevant requirements. By way of example, the treatment solution may be provided by placing the composition including textile binding agent and barrier agent together with the dye solution used to dye the textile. The textile may then be treated with the composition of the present invention and dyed at the same time. For example if level dyeing acid dyes are used for dyeing the textile, the textile treatment according to the present invention can be done during the dyeing either from an exhaust bath or in a continuous dyeing process. The composition of the present invention may be simply added to the dye liquor and the dyeing may be carried out as normal.

For other classes of dye commonly used on wool, for example premetallised and reactive dyes, the stain resist finish is preferably applied as a dyebath post treatment to avoid partial blocking of the dyes. For example, the composition of the present invention may be added to the boiling dyebath at the end of the dyeing process and the dyebath may be kept boiling for a sufficient time to effect the treatment of the textile according to the present invention. For example the dyebath may be kept boiling for approximately a further 30 minutes.

It will be appreciated that the method of the present invention could be carried out in a "closed" or at least "partially closed" system in which the solution including the composition is applied to the textile under pressure. It will be appreciated that the pressure should not be sufficient that damage would be caused to the textile. It will be further appreciated that the temperature and composition reaction time will vary in relationship with the pressure used.

The textile treated in the manufacturing process is preferably treated with a common salt application liquor during or subsequent to dyeing. The treatment with the common salt application liquor may take place concurrent with or subsequent to treatment with the composition in accordance with the method of the present invention. Most preferably the common salt application liquor is applied at the same time as the treatment composition. The concentration of common salt may be about 4 to 30% to the weight of the textile to be treated, preferably 4 to 10% and most preferably 4 to 5%.

In a further method according to the present invention the textile may be treated either by applying the textile binding agent or barrier agent to the textile at a time different to the time at which the other agent is applied to the textile. In one preferred form the textile will be treated in a solution including textile binding agent and at a later stage in the treatment process a solution including barrier agent is used to treat the textile; or vice versa. For example, the textile is treated with a solution including textile binding agent concurrent with dyeing of the textile and barrier agent is included subsequent to the dyeing process. The textile is preferably treated with a common salt application liquor concurrent with or subsequent to treatment with the barrier agent.

It has been found that the following are exemplary conditions in which the method of the present application may be performed;

(a) in the case of wool and wool/nylon blends using a continuous dyeing method, the textile treatment method of the present invention is performed concurrently with the dyeing process. An aqueous solution consisting of acid levelling dye stuffs, textile binding agent, preferably 7.5% "Paranyl B" or 25% "Sandospace R" barrier agent, preferably 3.75%, and common salt, preferably 5%, is buffered to a pH of between 3.0 and 6.0 depending on the required dyeing conditions. The solution is applied to the wool or wool/nylon blend by any commonly used technique such as padding, flooding, spraying or printing. The application rates mentioned above are based on the weight of textile treated. The textile is then steamed at between 95° C. and 100° C. for a sufficient time to fix the dye stuff and the textile treatment composition, usually about 3 to 6 minutes. The textile is then rinsed and dried.

(b) In the case of application to wool and wool/nylon blends a batch wise exhaustion of the dye stuff and textile treatment composition may also be conducted concurrently. The textile binding agent, preferably 7.5% "Paranyl B" or 25% "Sandospace R" , barrier agent, preferably 3.75%, and common salt, preferably 5%, based on the weight of the textile to be treated is added to a bath at the beginning of the dyeing process together with acid levelling dye stuffs and a suitable acid to give a pH of between 3.0 and 6.0. The dyeing process is carried out as normal.

(c) The above continuous dyeing and batch wise exhaustion processes may similarly be carried out on polyamide textiles except that the suitable percentages of the textile binding agent is 1.2% of "Paranyl B" or 4% of "Sandospace R" based on the weight of the textile and 1.5% barrier agent based on the weight of the textile, and common salt 4 to 5% based on the weight of the textile.

Whilst we do not wish to be restricted by theory, it is postulated that the achievement of stain-resistant properties imparted to the textile can be accounted for in the following way. Treatment of the textile with the textile binding agent will result in attach of groups on the textile such as amino groups on wool (for example on lysine residues) with the triazine ring, resulting in displacement of one of the chlorines as chloride ion. For example:

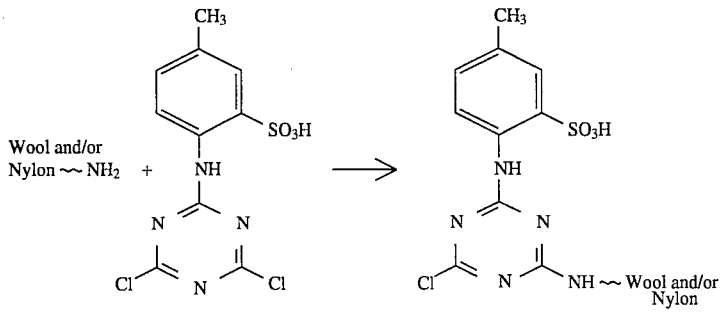

For steric reasons, it is believed that it is unlikely that the second chlorine could also be displaced by another wool amino group.

The second chlorine, it is postulated, is displaced by another nucleophile, such as the phenolic constituents of the barrier agent. For example:

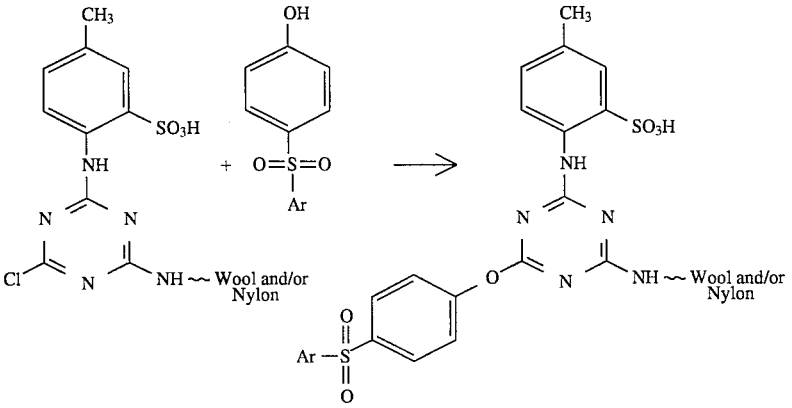

In the above example, since the textile binding agent is covalently and irreversably bound to the textile and the barrier agent is covalently and irreversably bound to the binding agent, the textile is effectively coated with an organic structure containing numerous highly polar acidic groups (i.e. $SO_3H$ and

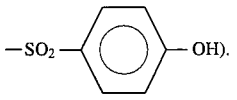

Such groups would present electrostatic repulsion to incoming staining molecules and not allow them to bind strongly. In the case of wool, the usual wool protein structures would be effectively protected by a veneer of polymer-like structures. The original dye molecules applied prior to or together with the composition of the present invention would remain fast and not be destabilised as they would be embedded in the above coating.

It has also been found that treatment of textiles by the composition of the present invention results in textiles having a good twist retention and improved wearability. It is postulated that the internal charge repulsion of the polar acidic groups attached to the modified textile provide a steric stiffening of the fibre, which results in the good twist retention and improved wearability.

The present invention also provides a textile having improved stain-resist properties, and/or improved twist retention and/or improved wearability. The textile according to the present invention comprises a textile which has been treated with the composition of the present invention. Preferably the textile of the invention has been treated according to the method of the present invention as described above.

It has also surprisingly been found that the durability of the stain resist treatment of the present invention is superior to known stain resist finishes on nylon carpets.

The present invention also provides a textile treatment kit comprising:

a first component textile binding agent which forms a chemical bond with the outer layer of the textile, in a suitable container; and a second component barrier agent which forms a chemical bond with said binding agent and which increases the surface tension of the textile, in a suitable container.

The present invention will now be more fully described with reference to the accompanying examples. It should be understood, however, that the description following is illustrative only and should not be taken in any way as a restriction on the generality of the invention described above.

EXAMPLE 1

In the following example a sample of wool carpet was treated with a composition comprising "Cibatex RN" and "Paranyl B". The following table illustrates the stain resist properties of untreated carpet compared to treated carpet.

TABLE 1

Staining of a carpet with FD & C Red 40 and various foodstuffs.

| | Evaluation of the staining | | | |
|---|---|---|---|---|
| | Carpet Untreated | | Carpet Treated | |
| | A | B | A | B |
| FD & C Red 40 | strong | strong | some | nil |
| Red wine | strong | some | some | trace |
| Coffee | strong | strong | definite | some |
| Coca Cola | trace | nil | nil | nil |
| Ketchup | strong | strong | definite | definite |
| Cordial (raspberry) | strong | definite | some | trade |
| Gravy | definite | some | some | trace |
| Tea | trace | trace | nil | nil |
| Chocolate drink | some | trace | trace | nil |
| Red vinegar | definite | some | some | trace |
| Mayonnaise | definite | definite | definite | some |
| Jam (blue) | some | some | some | trace |

Legend:
A The stain was immediately dabbed twice with a wet sponge
B The carpet was rinsed for 5 minutes with running cold water
nil The stain was completely removed
trace Slight circular staining, still able to see
some Light stain is visible
definite Stain definitely visible
strong No stainblock effect F D & C Red 40 is Food, Drug & Cosmetic Red Dye No. 40 which is an artificial colorant commonly added to foods, beverages, medicines, cosmetics etc.

As can be seen above, the treated carpet showed a very good stain block effect on a wood carpet when tested with F D & C Red 40. To the best of the Applicants knowledge, there is no compound on the market which has the same effect.

EXAMPLE 2

In the following example the 3M carpet stain release test 1 was used. This test is designed to provide a simple standard method for measuring and rating the effectiveness of removing stains from carpet.

The following is the 3M carpet stain release test 1 procedure and evaluation:

Test Procedure

1. Test pH of staining test solution. It must be between 2.5–4.0. Record pH value. Water temperature should be 21°±3° C.
2. Draw 15 ml of staining test solution into the applicator syringe, avoid bubbles.
3. Place the applicator in the center of the carpet face.
4. Twist the applicator from left to right so it touches the carpet backing. With heavy face weights this is not always possible, strive for deepest penetration achievable.
5. Slowly depress plunger of the syringe to stain the carpet with the staining test solution in the syringe. Wait a few seconds to insure all staining test solution has transferred into the carpet.
6. Place hands evenly on base of the applicator, twist from left to right.
7. Remove applicator and allow stained carpet to sit undisturbed for 8 hours on a hard, nonabsorbent surface.
8. Rinse the carpet well under flowing tap water 21°±3° C. for a minimum of 3 minutes.
9. Remove excess water by squeezing or an extraction method.
10. Allow rinsed sample to air dry completely.

Evaluation

1. Place the 3M Stain Release Rating Scale 1–8 against the back wall of a Lighting chamber.
2. Place test sample in front of the Rating Scale. On cut pile carpet brush the pile with your hand in the direction giving the greatest lay to the yarn.
3. Visually rate stained area by comparing to the rating scale. Each test sample will be rated two times. The first time with the pile lay facing the rating scale. The second time, rotated 90°from the first rating position. Record each rating to the nearest ½ point.
4. Average the 2 ratings for each test sample. If the final value is between half point increments, round to the next higher half point increment (example: 1st value=3.5, 2nd value=4.0, average=3.75; Record the value as 4.0).

A sample of carpet was treated with "Paranyl B" at 100° C. for 30 minutes with 5% common salt. Table 2 illustrates the various amounts of "Paranyl B" which were applied and whether the sample passed or failed the above test.

TABLE 2

| | Amount of "Paranyl B" | Pass/Fail |
|---|---|---|
| A) | 5% | Fail |
| B) | 10% | Fail |
| C) | 15% | Fail |
| D) | 20% | Fail |

A further test was conducted using "Cibatex RN". A sample of carpet was treated with "Cibatex RN" at 100° C. for 30 minutes with 5% common salt. Table 3 illustrates the amount of "Cibatex RN" which was used and whether the carpet passed or failed the test.

TABLE 3

| | Amount of "Cibatex RN" | Pass/Fail |
|---|---|---|
| A) | 2½% | Fail |
| B) | 5% | Fail |
| C) | 7½% | Fail |
| D) | 10% | Fail |

A sample of carpet was then treated with a composition comprising a mixture of 7.5% "Paranyl B" with 3.75% "Cibatex RN" and 5% common salt. The carpet was treated at 100° C. for 30 minutes. The sample of carpet treated with this composition according to the present invention had no trouble passing the 3M carpet stain release test.

EXAMPLE 4

The 3M carpet stain release test 1 was also carried on a nylon carpet which had been treated with a composition comprising 1.8% "Paranyl B", 1.0% "Thiotan WPN" liquid, and 4% common salt. The carpet passed the 3M carpet stain release test 1.

EXAMPLE 5

A sample of carpet which had been treated by composition comprising "Cibatex RN" and "Paranyl B" was compared with an untreated sample of carpet using 4 commonly used tests in the industry. The carpet used was a 100% wool carpet. Each method was rated against Grey Scales for staining by three judges to give the required ratings.

The staining was rated against a new carpet sample, any change in colour tone of carpet was neglected and only the stained area was considered.

| | |
|---|---|
| Method I | 3M - Stain Release Test 1 - 8 hours |
| Method II | 3M - Stain Release Test II - Heat 60° C. 1 minute |
| Method III | Stainmaster Dry - 24 hours |
| Method IV | Stainmaster Wet - 24 hours |

The following Table 4 illustrates the ratings of the treated and untreated samples.

TABLE 4

| Method | I | II | III | IV |
|---|---|---|---|---|
| Treated Carpet | 4 | 4 | 3 | 3–4 |
| Untreated carpet | 2 | 1–2 | 2 | 2 |

A rating of 4 is considered to be very good, only very slight colouration on the tips of yarn.

As can be seen above, the stain has effectively been removed in the treated sample under all of the above tests.

EXAMPLE 6

Two polyamide carpets namely a 32 ounce per square yard plush pile obtained from DuPont and T66 Superba Heat Set Continuous Filament yarn were treated by two different methods:

(a) DuPont "Stain Release" method (b) Textile treatment method according to the present invention.

In every other respect, the two carpet samples were finished and treated similarly.

Samples of each carpet were then subjected to rapid wear tests on a hexapod wear tester through 6000 and 9000 cycles. Both worn and unworn samples were then subjected to the 3M 8 hour stain test and the DuPont 24 hour stain test. The results are shown in Table 5.

TABLE 5

| | | DuPont 24 hour Test | |
|---|---|---|---|
| | 3M 8 Hour Test rating | Unwashed rating | Prewashed rating |
| Unworn Samples | | | |
| Textile treatment Method of present invention | 8.0 | .80 | 8.0 |
| DuPont "Stain Release" Treatment | 8.0 | 8.0 | 8.0 |
| Hexapod 6000 cycles | | | |
| Textile treatment Method of present invention | 7.5 | 7.5 | 7.0 |
| DuPont "Stain Release" Treatment | 7.0 | 7.5 | 6.0 |
| Hexapod 9000 cycles | | | |
| Textile treatment Method of present invention | 7.5 | 7.0 | 7.0 |
| DuPont "Stain Release" Treatment | 5.5 | 7.5 | 3.0 |

Rating scale

TABLE 5-continued

| | | DuPont 24 hour Test | |
|---|---|---|---|
| | 3M 8 Hour Test rating | Unwashed rating | Prewashed rating |

8.0 = No Stain
1.0 = Completely Stained

The above table illustrates the significantly improved durability of the textile treatment method of the present invention over the commonly used DuPont "Stain Release" method.

EXAMPLE 7

The example illustrates the improved twist retention and wearability of a carpet sample which has been treated with the textile treated treatment composition of the present invention.

A 100% wool cut pile carpet weighing 50 ounces per square yard was tufted on a 1/10 Guage Tufting machine. Half of this carpet was dyed using acid levelling dyes on an industry standard continuous dyeing line. The other half of the carpet was dyed under the same conditions but incorporating the textile treatment composition of the present invention in with the dyeing liquor. The two samples of carpet were then subjected to 8600 cycles of a hexapod wear testing machine and each sample was then rated for appearance retention using a grey scale rating system from 1 to 5 in which 5 indicates no change in appearance. The results are 15 provided in Table 6.

TABLE 6

| | Grey scale Rating after 8600 cycles |
|---|---|
| Normally Dyed Carpet | 2–3 |
| Carpet Dyed including Textile Treatment Composition of present invention | 3–4 |

The above results illustrate the considerable improvement in wearability of carpets treated with the textile treatment composition of the present invention.

EXAMPLE 8

The following example illustrates the superior stain resist properties of a wool carpet which has been treated with the textile treatment composition of the present invention. Table 7 illustrates the results of staining trials on a wool carpet. The results are expressed as total colour difference (WE). A conversion to Grey Scale Ratings is also provided.

TABLE 7

RESULTS OF STAINING TRIALS ON WOOL CARPET

| Untreated | | | | Treated | | | |
|---|---|---|---|---|---|---|---|
| Raspberry Cordial | | Coffee | | Raspberry Cordial | | Coffee | |
| 1 hr WE | 24 hrs WE | 1 hr WE | 24 hrs WE | 1 hr WE | 24 hrs WE | 1 hr WE | 24 hrs WE |

TABLE 7-continued

RESULTS OF STAINING TRIALS ON WOOL CARPET

| | Untreated | | | | Treated | | | |
|---|---|---|---|---|---|---|---|---|
| | Raspberry Cordial | | Coffee | | Raspberry Cordial | | Coffee | |
| | 1 hr WE | 24 hrs WE | 1 hr WE | 24 hrs WE | 1 hr WE | 24 hrs WE | 1 hr WE | 24 hrs WE |
| Not Worn | | | | | | | | |
| Not cleaned | 25.0 | 28.2 | 15.9 | 16.8 | 2.4 | 3.0 | 7.4 | 5.2 |
| Sp. extracted | 25.3 | 24.5 | 15.3 | 16.2 | 2.6 | 3.0 | 6.7 | 5.2 |
| Shampooed 1500 Vettermann Drum | 11.3 | 16.7 | 14.5 | 18.2 | 5.8 | 6.7 | 11.0 | 11.5 |
| Not cleaned | 29.3 | 32.8 | 16.8 | 20.2 | 5.7 | 7.1 | 8.1 | 9.2 |
| Sp. extracted | 32.9 | 33.3 | 16.7 | 18.1 | 4.3 | 9.5 | 8.3 | 11.1 |
| Shampooed 2500 Vetterman Drum | 12.9 | 20.3 | 12.4 | 19.1 | 4.7 | 13.2 | 9.7 | 15.8 |
| Not cleaned | 30.9 | 29.1 | 14.3 | 19.5 | 7.0 | 10.6 | 9.7 | 12.3 |
| Sp. extracted | 30.3 | 32.2 | 16.3 | 17.9 | 7.9 | 11.6 | 11.5 | 15.1 |
| Shampooed 8000 Vettermann Drum | 23.8 | 22.4 | 13.8 | 18.1 | 7.8 | 14.9 | 14.3 | 17.6 |
| Not cleaned | 30.2 | 25.4 | 12.9 | 19.2 | 10.4 | 11.8 | 11.6 | 12.9 |
| Sp. extracted | 30.5 | 32.4 | 15.9 | 19.9 | 13.3 | 19.0 | 11.8 | 13.3 |
| Shampooed | 22.2 | 22.4 | 13.5 | 19.8 | 5.9 | 13.9 | 12.7 | 16.2 |

WE is equivalent to Grey Scale Rating (staining):
0 5
2.2 4–5
4.3 4
6.0 3–4
8.5 3
12.0 2–3
16.9 2
24.0 1–2
34.1 1
5 = No Staining
1 = Severe Staining

EXAMPLE 9

A sample of 10 g of a woollen carpet yarn is treated in the dye apparatus with a liquor in the liquor ratio of 1:30 which contains 7.5%* of the sodium salt of 4-[(4,6-dichloro -1,3, 5-triazin-2-yl)amino] benzene sulphonic acid (a) 10% NaCl.

The pH of the liquor is adjusted to 5.5 with acetic acid. (* all percentage figures are based on the weight of material)

The liquor is heated to 98° C., the previously moistened sample is immersed in the liquor and treatment is carried out for 30 minutes at this temperature. After this 3.75% of the ammonium salt of a condensation product of naphthalene sulphonic acid, dihydroxy-diphenylsulphone and formaldehyde (b) is added to the treatment bath, and treatment is continued for 30 minutes at 98° C. Subsequently the material is rinsed and dried.

EXAMPLE 10

The procedure is the same as in Example 9, however, instead of the benzene sulphonic acid derivative specified there, 7.5% 2-[(4,6-dichloro-1,3,5-triazin-2-yl)amino] naphthalene-1,5-disulphonic acid (c) is used.

EXAMPLE 11

The procedure is the same as in Example 9, however, instead of the condensation product specified there, 3.75% of a condensation product of phenol sulphonic acid and dihydroxydiphenylsulphone with 0.4 mole of formaldehyde (d) is used.

EXAMPLE 12

The procedure is the same as in Example 9, however, instead of the woollen carpet yarn a sample of 10 g of a woollen carpet of 350 g/m$^2$ is used and instead of the benzene sulphonic acid derivative, 7.5% of the naphthalene-1,5disulphonic acid derivative of Example 10 is used, and instead of the condensation product of Example 9, the condensation product of Example 11 is used.

EXAMPLE 13

The procedure is the same as in Example 12, however, instead of the naphthalene-1,5-disulphonic acid derivative, 7% of the derivative according to example 9 is used and instead of the condensation product of Example 11, 3.5% of the condensation product of phenol sulphonic acid and dihydroxydiphenylsulphone with 0.58 moles formaldehyde (e) is used.

EXAMPLE 14

The procedure is the same as in Example 9, however, instead of the benzene sulphonic acid derivative, 7.0% of the naphthalene-1,5-disulphonic acid derivative of Example 10 is used, and instead of the condensation product of Example 9 3.5% of the condensation product according to Example 13 is used.

Comparative Examples A–F

Six samples of woollen carpet yarn of 10 g each are treated with liquor in the liquor ratio of 1:30 which contain 10% NaCl and each 7.5% of the component (a) or (b) or 3.75% of the component (c), (d) or (e), respectively not a single component.

The pH value of the liquors is adjusted to 5.5 with acetic acid.

The moistened samples are then immersed in the liquors which have been heated to 98° C. and treatment is carried out for 60 minutes at this temperature. Subsequently, the samples are rinsed cold and dried.

The samples which were dressed according to the Examples 9 to 14 and the comparative Examples A to F are each separately immersed at a liquor ratio of 1:20 in a liquor at 20° C. which contains 80mg/L of the acid dye FD & C Red 40 and 0.5 g/L of citric acid (pH 3) and are kept there for 15 minutes at this temperature. After this they are rinsed cold for 5 minutes and are dried at 60° C.

The results are summarised in Table 1.

TABLE 1

| Sample according to | Evaluation of the dyeing | Evaluation of the stain resistance |
|---|---|---|
| Example 9 | none | good |
| Example 10 | none | good |
| Example 11 | none | good |
| Example 12 | none | good |
| Example 13 | none | good |
| Example 14 | none | good |
| Example A | clearly | moderate |
| Example B | clearly | moderate |
| Example C | clearly | moderate |
| Example D | clearly | moderate |
| Example E | clearly | moderate |
| Example F | clearly | poor |

EXAMPLE 15

The specimen of 10 g of a wool carpet yarn is dyed with a solution which, relative to the mass of the yarn, contains 0.026% of the dye with the formula

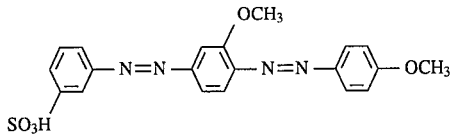

0.02% of the dye with the formula

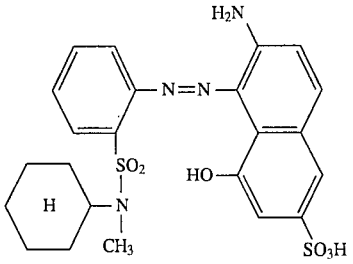

0.038% of the dye with the formula

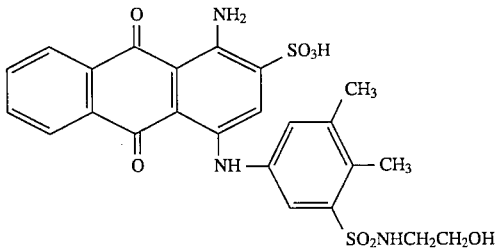

10.0% sodium sulphate decahydrate 7.5% of the component (a) of Example 9 and 3.75% of the component (d) of Example 11.

The pH of the dye liquor is adjusted to 5 with acetic acid.

The pre-moistened sample is immersed in the liquor which has been treated to 40° C., and the temperature is then raised to 80° C. over a period of 30 minutes and dyeing proceeds at that temperature for an hour. After that the sample is cooled down over a period of 10 minutes to 60° C., and is then rinsed in running water and is subsequently dried.

Comparative Example G

A second sample is dyed and after treated as described, in a further dye liquor which, however, does not contain the components (a) and (d).

The samples so obtained are tested on their stain resistance as in the comparative samples A–F.

The results are summarised in Table II:

TABLE II

| Sample according to | Evaluation of dye acceptance | Evaluation of stain resistance |
|---|---|---|
| Example 15 | none | good |
| Example G | strong | poor |

It will be appreciated that many variations, modifications and alterations may be made to the above described method, composition and products including components, qualities and conditions, without departing from the ambit of the present invention.

We claim:

1. A textile treatment composition useful for treating a textile comprising:

(a) a textile binding agent which forms a chemical bond with the outer layer of the textile which is a compound according to formula (Ia):

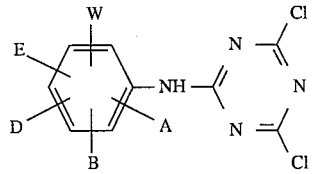

(Ia)

wherein W is $SO_3H$ and A, B, D and E, which are the same or different, are hydrogen or halogen atoms, or hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, $—CO_2R^1$, $—CONR^1R^2$, $—COR^1$, $—CR^1=NR^2$, $—N=CR^1R^2$ or $—S(O)_nR^1$ groups, any two of the groups A, B, D and E, when they are in adjacent positions on the ring, optionally join to form a fused ring, either aromatic or aliphatic, optionally containing one or more heteroatoms; n is 0, 1 or 2; and $R^1$ and $R^2$, which are the same or different, are hydrogen atoms or alkyl, cycloalkyl, cycloalkylalkyl, alkenyl, alkynyl, optionally substituted aryl or optionally substituted aralkyl groups, and, (b) a barrier agent which forms a chemical bond with said binding agent and which increases the surface tension of the textile.

2. A textile treatment composition according to claim 1 wherein the textile binding agent is selected from:

2-[(4,6-dichloro-1,3,5-triazin-2-yl)amino]-5-methylbenzene sulphonic acid; 3-[(4,6 -dichloro-1,3,5-triazin-2-yl)amino]-4-methylbenzene sulphonic acid; 5-[(4,6-dichloro- 1,3,5-triazin-2-yl)amino]-2-methylbenzene sulphonic acid; a sodium salt of 2,4,-dichloro- 6-p-sulphoaniline 1,3,5 triazine; 4-[(4,6-dichloro-1,3,5-triazin-2-yl)amino]benzene sulphonic acid; 4-[(4,6-dichloro-1,3,5-triazin-2-yl)amino]naphthalene-1,5-disulphonic acid; 2,4,6-trichloro-1,3,5-triazine and mixtures thereof.

3. A textile treatment composition according to claim 1 wherein the barrier agent is a compound of formula (II):

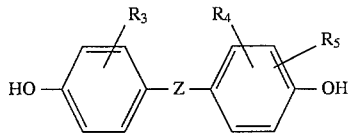

(II)

wherein $R_3$, $R_4$ and $R_5$ which may be the same or different are selected from hydrogen, halogen, hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, $—CO_2R^1$, $—CONR^1R^2$, $—COR^1$, $—CR^1{=}NR^2$, $—N{=}CR^1R^2$ or $—S(O)_nR^1$ groups; n is 0, 1 or 2; and $R^1$, and $R^2$, which are the same or different, are hydrogen atoms or alkyl, cycloalkyl, cycloalkylalkyl, alkenyl, alkynyl, optionally substituted aryl or optionally substituted aralkyl groups and Z is an electron drawing group.

4. A textile treatment composition according to claim 1 wherein the barrier agent is selected from:

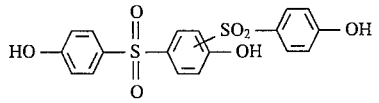

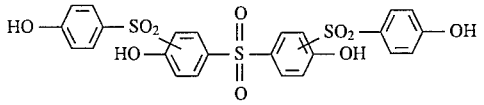

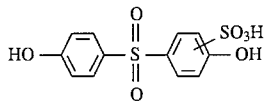

and

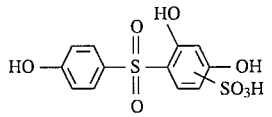

and mixtures thereof.

5. A textile treatment composition according to claim 1 wherein the textile is wool or a wool/nylon blend and the weight ratio of textile binding agent to barrier agent is between 2:1 and 7:1.

6. A textile treatment composition according to claim 1 wherein the textile is nylon and the weight ratio of textile binding agent to barrier agent is between 0.8:1 and 3:1.

7. A textile treatment composition according to claim 1 further comprising an alkali metal salt.

8. A method of treating a textile to render it stain-resistant including:

providing a textile; and treating the textile with a textile binding agent which forms a chemical bond with the outer layer of the textile where the textile binding agent is a compound according to formula (Ia):

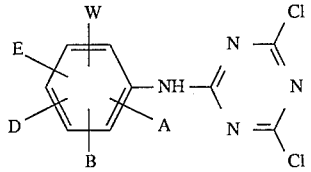

(Ia)

wherein W is $SO_3H$ and A, B, D and E, which are the same or different, are hydrogen or halogen atoms, or hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, $—CO_2R^1$, $—CONR^1R^2$, $—COR^1$, $—CR^1{=}NR^2$, $—N{=}CR^1R^2$ or $—S(O)_nR^1$ groups, any two of the groups A, B, D and E, when they are in adjacent positions on the ring, optionally join to form a fused ring, either aromatic or aliphatic, optionally containing one or more heteroatoms; n is 0, 1 or 2; and $R^1$ and $R^2$, which are the same or different, are hydrogen atoms or alkyl, cycloalkyl, cycloalkylalkyl, alkenyl, alkynyl, optionally substituted aryl or optionally substituted aralkyl groups, and with a barrier agent which forms a chemical bond with said textile binding agent and which increases the surface tension of the textile.

9. A method according to claim 8, wherein the textile binding agent is selected from: 2-[(4,6-dichloro-1,3,5-triazin-2-yl)amino]-5-methylbenzene sulphonic acid; 3-[(4,6-dichloro-1,3,5-triazin-2-yl)amino]-4-methylbenzene sulphonic acid; 5-[(4,6-dichloro- 1,3,5-triazin-2-yl)amino]-2-methylbenzene sulphonic acid; a sodium salt of 2,4,-dichloro- 6-p-sulphoaniline-1,3,5-triazine; 4-[(4,6-dichloro-1,3,5-triazin-2-yl)amino]benzene sulphonic acid; 4-[(4,6-dichloro-1,3,5-triazin-2-yl)amino]naphthalene- 1,5-disulphonic acid; 2,4,6-trichloro-1,3,5-triazine and mixtures thereof.

10. A method according to claim 8, wherein the barrier agent is a compound of formula II:

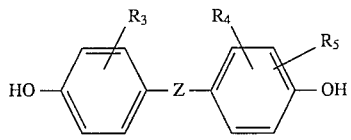

(II)

wherein $R_3$, $R_4$ and $R_5$ which may be the same or different are selected from hydrogen, halogen, hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, $—CO_2R^1$, $—CONR^1R^2$, $—COR^1$, $—CR^1{=}NR^2$, —N=CR$^1$R$^2$ or —S(O)$_n$R$^1$ groups, n is 0, 1 or 2; and R$^2$, which are the same or different, are hydrogen atoms or alkyl, cycloalkyl, cycloalkylalkyl, alkenyl, alkynyl, optionally substituted aryl or optionally substituted aralkyl groups and Z is an electron drawing group.

11. A method according to claim 8 wherein the barrier agent is selected from:

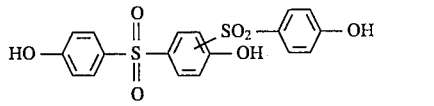

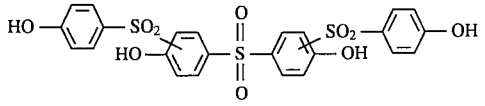

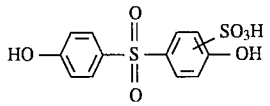

and

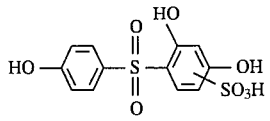

and mixture thereof.

12. A method according to claim 8 wherein the textile is wool or a wool/nylon blend and the weight ratio of textile binding agent to barrier agent is between 2:1 and 7:1.

13. A method according to claim 8 wherein the textile is nylon and the weight ratio of textile binding agent to barrier agent is between 0.8:1 and 3:1.

14. A textile treatment kit comprising:

a first component textile binding agent which forms a chemical bond with the outer layer of the textile, which is a compound of formula (Ia):

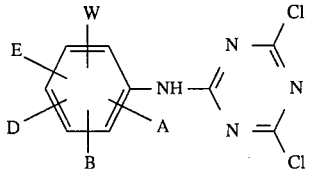

(Ia)

wherein W is $SO_3H$ and A, B, D and E, which are the same or different, are hydrogen or halogen atoms, or hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, —$CO_2R^1$, —$CONR^1R^2$, —$COR^1$, —$CR^1$=$NR^2$, —N=$CR^1R^2$ or —S(O)$_n$R$^1$ groups, any two of the groups A, B, D and E, when they are in adjacent positions on the ring, optionally join to form a fused ring, either aromatic or aliphatic, optionally containing one or more heteroatoms; n is 0, 1 or 2; and R$^1$ and R$^2$, which are the same or different, are hydrogen atoms or alkyl, cycloalkyl, cycloalkylalkyl, alkenyl, alkynyl, optionally substituted aryl or optionally substituted aralkyl groups, in a suitable container and a second component barrier agent which forms a chemical bond with said binding agent and which increases the surface tension of the textile, in a suitable container.

15. A textile treatment kit according to claim 14 wherein the textile binding agent is selected from: 2-[(4,6-dichloro-1,3,5-triazin-2-yl)amino]-5-methylbenzene sulphonic acid; 3-[(4,6-dichloro-1,3,5-triazin-2-yl)amino-4-methylbenzene sulphonic acid; 5-[(4,6 -dichloro-1,3,5-triazin-2-yl)amino]-2-methylbenzene sulphonic acid, a sodium salt of 2,4-dichloro- 6-p-sulphoaniline-1,3,5-triazine, 4-[(4,6-dichloro-1,3,5-triazin-2-yl)amino]benzene sulphonic acid; 4-[(4,6-dichloro-1,3,5-triazin-2-yl)amino]naphthalene- 1,5-disulphonic acid; 2,4,6-trichloro-1,3,5-triazine and mixtures thereof.

16. A textile treatment kit according to claim 14 wherein the barrier agent is a compound of formula II:

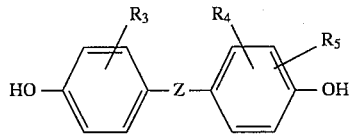

(II)

wherein $R_3$, $R_4$ and $R_5$ which may be the same or different are selected from hydrogen, halogen, hydroxy, optionally substituted alkyl, optionally substituted alkoxy, optionally substituted aralkyl, optionally substituted arylalkoxy, optionally substituted alkenyl, optionally substituted alkynyl, optionally substituted aryl, optionally substituted aryloxy, optionally substituted arylthio, optionally substituted heteroaryloxy, optionally substituted heteroarylthio, optionally substituted acyloxy, optionally substituted amino, optionally substituted arylazo, optionally substituted acylamino, nitro, cyano, —$CO_2R^1$, —$CONR^1R^2$, —$COR^1$, —$CR^1$=$NR^2$, —N=$CR^1R^2$ or —S(O)$_n$R$^1$ groups; n is 0, 1 or 2; R$^1$ and R$^2$, which are the same or different, are hydrogen atoms or alkyl, cycloalkyl, cycloalkylalkyl, alkenyl, alkynyl, optionally substituted aryl or optionally substituted aralkyl groups.

17. A textile treatment kit according to claim 14 wherein the barrier agent is selected from:

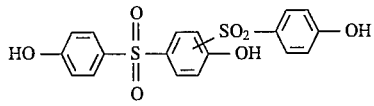

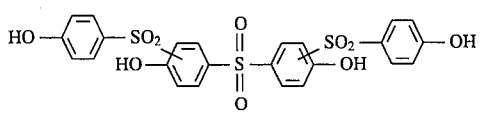

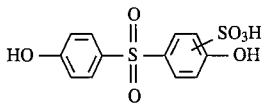

and

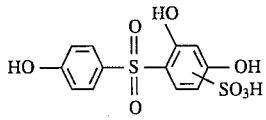

and mixtures thereof.

* * * * *